US010976061B2

(12) United States Patent
Kim et al.

(10) Patent No.: US 10,976,061 B2
(45) Date of Patent: Apr. 13, 2021

(54) AIR CONDITIONER INDOOR UNIT

(71) Applicant: SAMSUNG ELECTRONICS CO., LTD., Suwon-si (KR)

(72) Inventors: Young-Jae Kim, Yongin-si (KR); Do Yeon Kim, Uiwang-si (KR); Je Myung Moon, Hwaseong-si (KR); Hyeong Joon Seo, Suwon-si (KR); Bu Youn Lee, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 98 days.

(21) Appl. No.: 15/777,734

(22) PCT Filed: Nov. 17, 2016

(86) PCT No.: PCT/KR2016/013277
§ 371 (c)(1),
(2) Date: May 21, 2018

(87) PCT Pub. No.: WO2017/086716
PCT Pub. Date: May 26, 2017

(65) Prior Publication Data

US 2018/0340699 A1 Nov. 29, 2018

(30) Foreign Application Priority Data

Nov. 20, 2015 (KR) ..... 10-2015-0163145

(51) Int. Cl.
*F24F 1/0011* (2019.01)
*F24F 1/0047* (2019.01)
(Continued)

(52) U.S. Cl.
CPC ..... *F24F 1/0011* (2013.01); *F24F 1/0033* (2013.01); *F24F 1/0047* (2019.02);
(Continued)

(58) Field of Classification Search
CPC ..... F24F 1/0011; F24F 1/0047; F24F 1/0033; F24F 13/10; F24F 13/20; F24F 11/79; F24F 1/0037
See application file for complete search history.

(56) References Cited

U.S. PATENT DOCUMENTS 4,526,227 A 7/1985 Baker
2002/0152760 A1 10/2002 Okuda et al.
2012/0225618 A1* 9/2012 Nouchi ..... F24F 1/0011 454/258

FOREIGN PATENT DOCUMENTS

CN 2442168 Y 8/2001
CN 100408931 C 8/2008
(Continued)

OTHER PUBLICATIONS

CN104896590A translation.*
(Continued)

*Primary Examiner* — Elizabeth J Martin
(74) *Attorney, Agent, or Firm* — Staas & Halsey LLP

(57) ABSTRACT

Disclosed is an air conditioner (AC) indoor unit including a housing installed on the ceiling and having an inlet and an outlet provided around the inlet and having a pair of straight sections facing each other and a pair of curved sections facing each other; a heat exchanger provided inside the housing and arranged in a main flow path between the inlet and the outlet; a blower fan configured to suck in air through the inlet, allow the air to exchange heat with the heat exchanger, and discharge the air through the outlet; and an auxiliary flow path guiding an auxiliary air current to change a direction of an air current discharged from the outlet. The direction of the discharged air current may be controlled by sucking in air around the outlet or blowing air to the periphery of the outlet through the auxiliary flow path without a blade.

14 Claims, 13 Drawing Sheets

(51) Int. Cl.

| | |
|---|---|
| ***F24F 11/79*** | (2018.01) |
| ***F24F 13/20*** | (2006.01) |
| ***F24F 13/10*** | (2006.01) |
| ***F24F 1/0033*** | (2019.01) |

(52) U.S. Cl.
CPC ..... *F24F 11/79* (2018.01); *F24F 13/10* (2013.01); *F24F 13/20* (2013.01)

(56) References Cited

FOREIGN PATENT DOCUMENTS

| | | | | |
|---|---|---|---|---|
| CN | 102597646 | A | | 7/2012 |
| CN | 203274149 | U | | 11/2013 |
| CN | 104896590 | | | 9/2015 |
| CN | 104896590 | A | * | 9/2015 |
| CN | 205783340 | | * | 7/2016 |
| EP | 0 483 977 | | | 5/1992 |
| EP | 1 688 677 | | | 8/2006 |
| EP | 2 498 019 | | | 9/2012 |
| KR | 10-0273353 | | | 9/2000 |
| KR | 2000-0055145 | | | 9/2000 |
| KR | 10-2006-0115484 | | | 11/2006 |
| KR | 10-0806576 | | | 2/2008 |

OTHER PUBLICATIONS

CN 205783340 translation.*
Extended European Search Report dated Jan. 31, 2019 from European Patent Application No. 16866668.3, 10 pages.
European Office Action dated Oct. 5, 2018 from European Patent Application No. 16 866 668.3, 2 pages.
International Search Report dated Feb. 13, 2017 in corresponding International Patent Application No. PCT/KR2016/013277, 7 pages.
Chinese Office Action dated Nov. 5, 2019 from Chinese Patent Application No. 201680067737.2, 21 pages.

* cited by examiner

【Fig. 1】
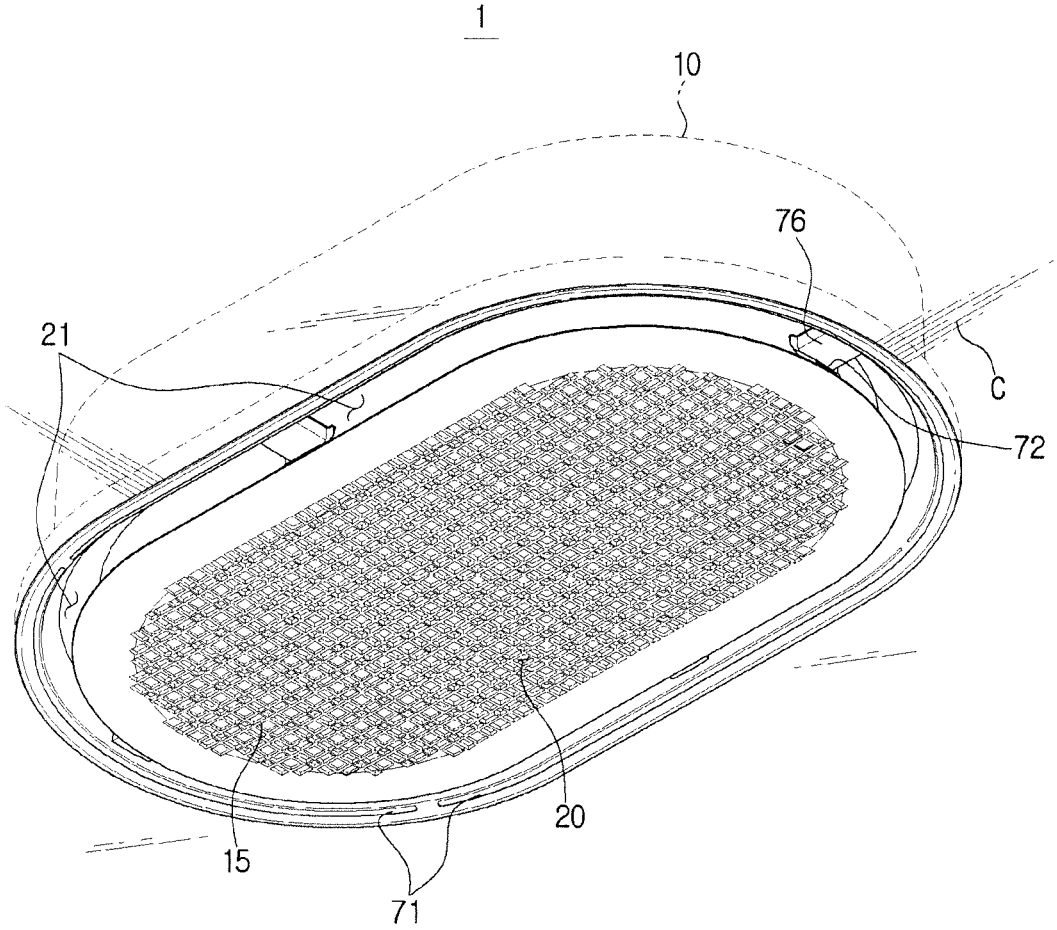

【Fig. 2】
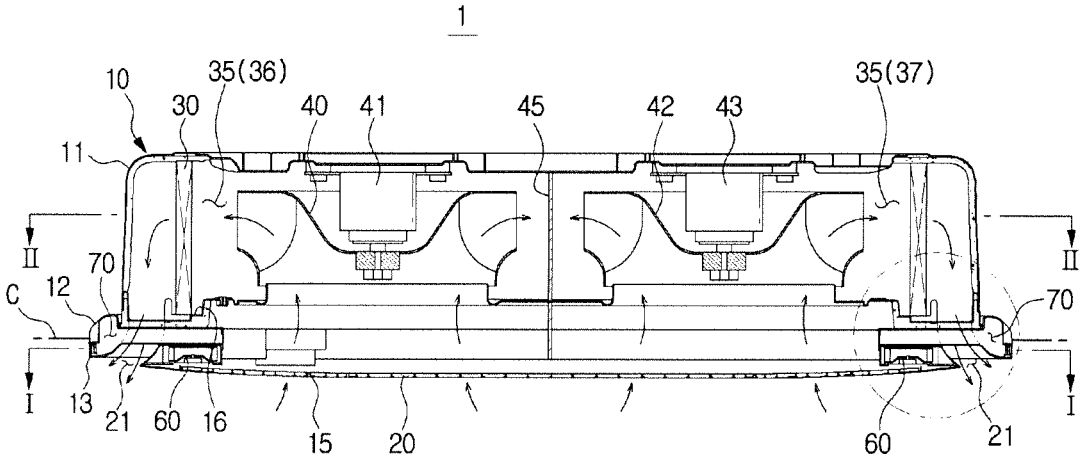

【Fig. 3】
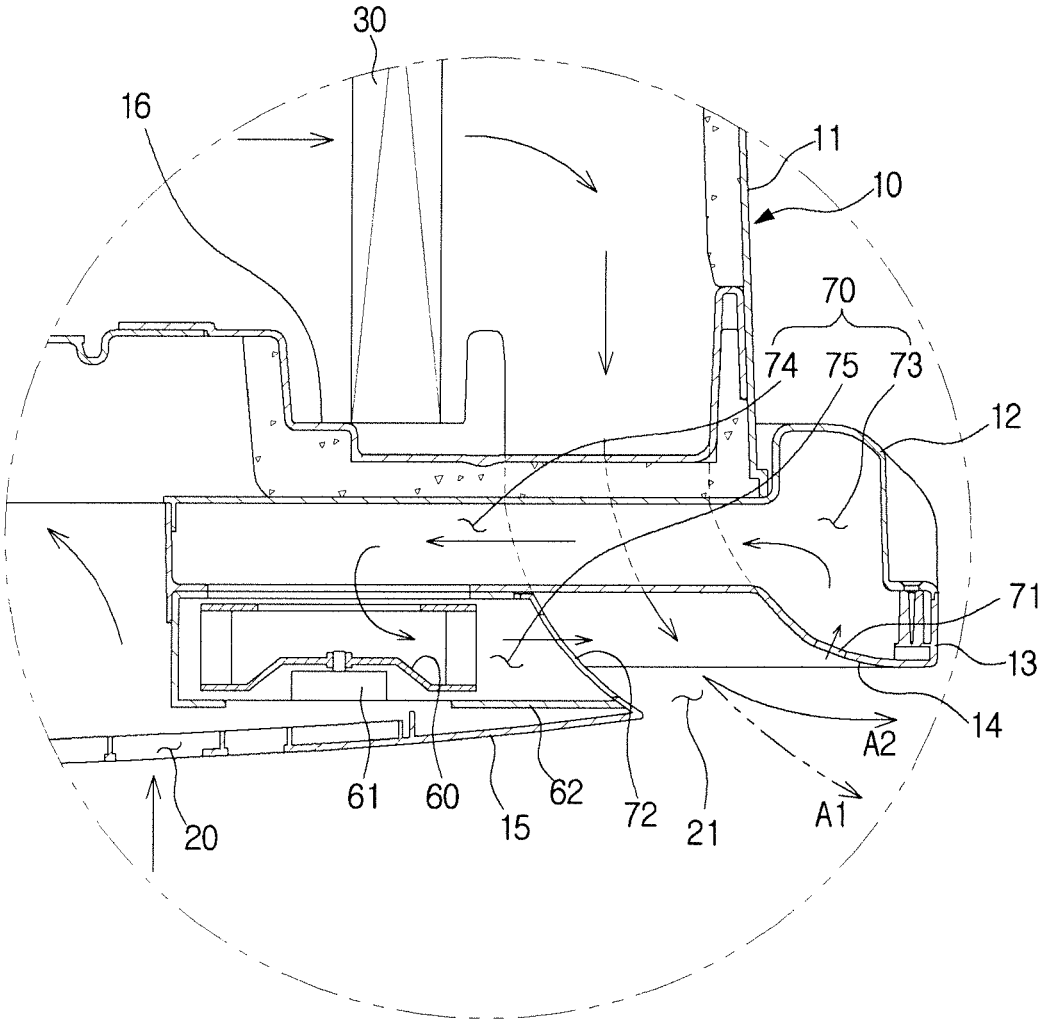

【Fig. 4】
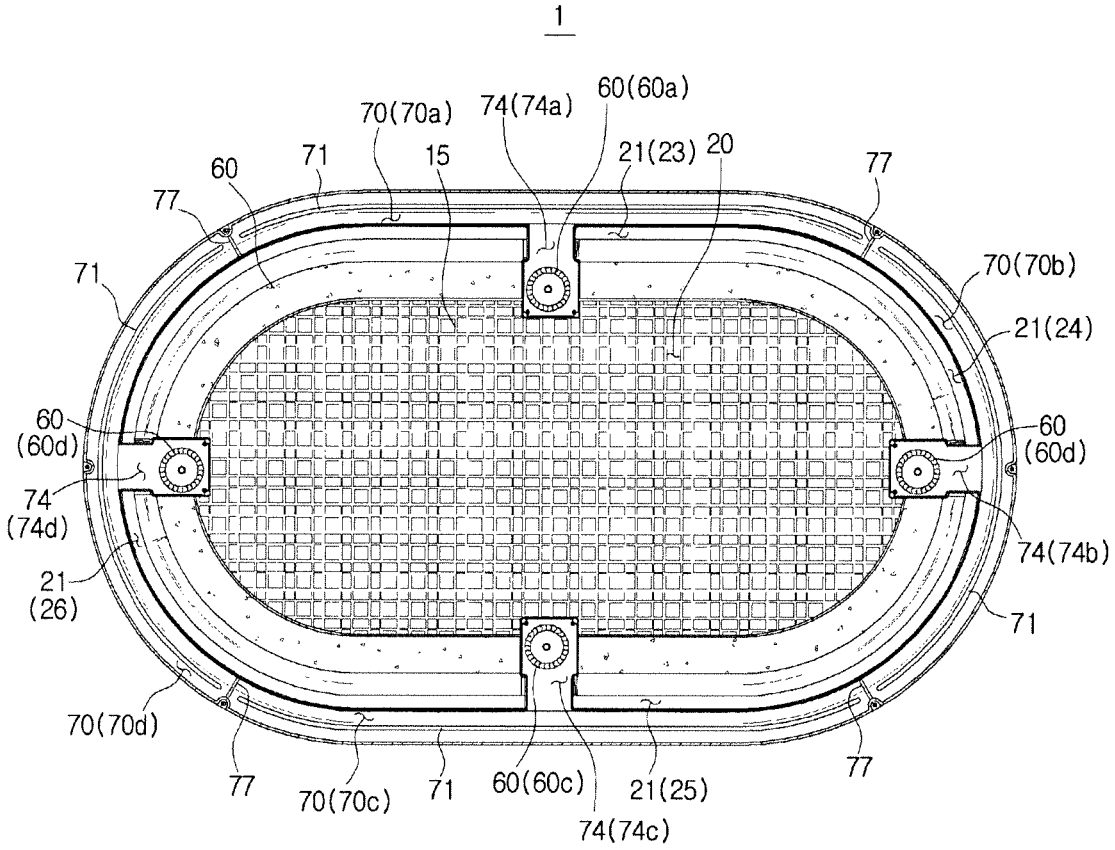

【Fig. 5】
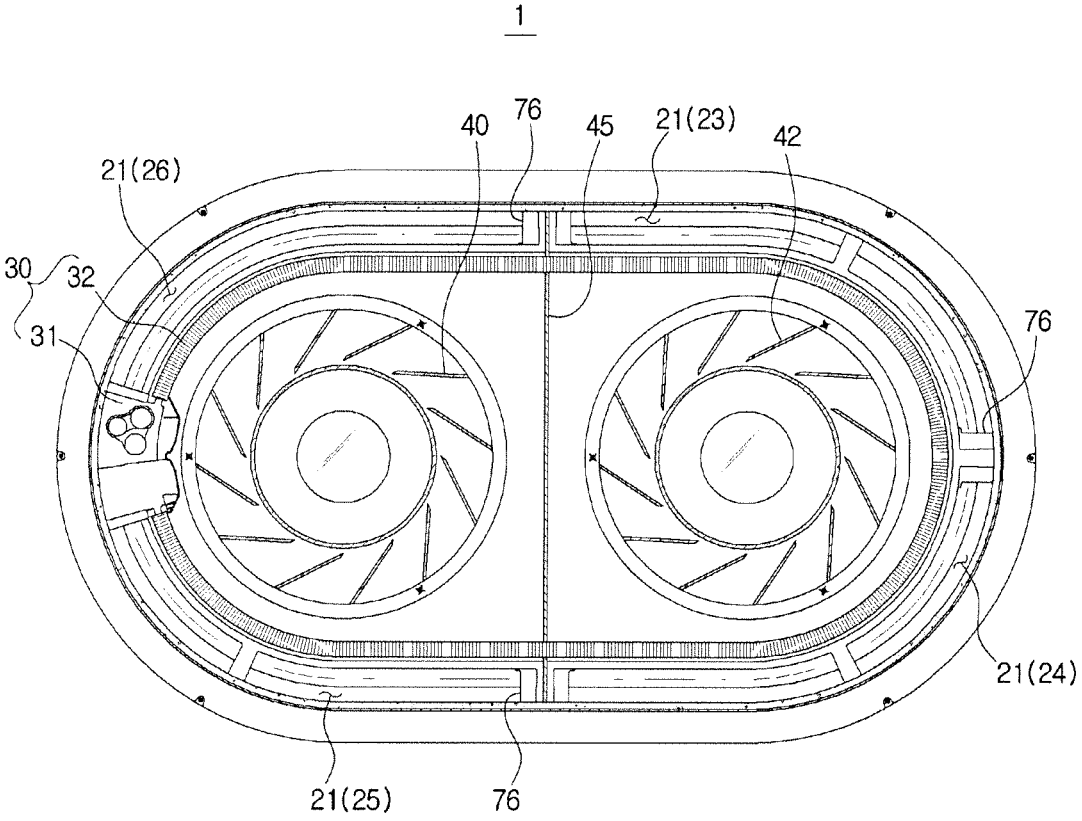

【Fig. 6】
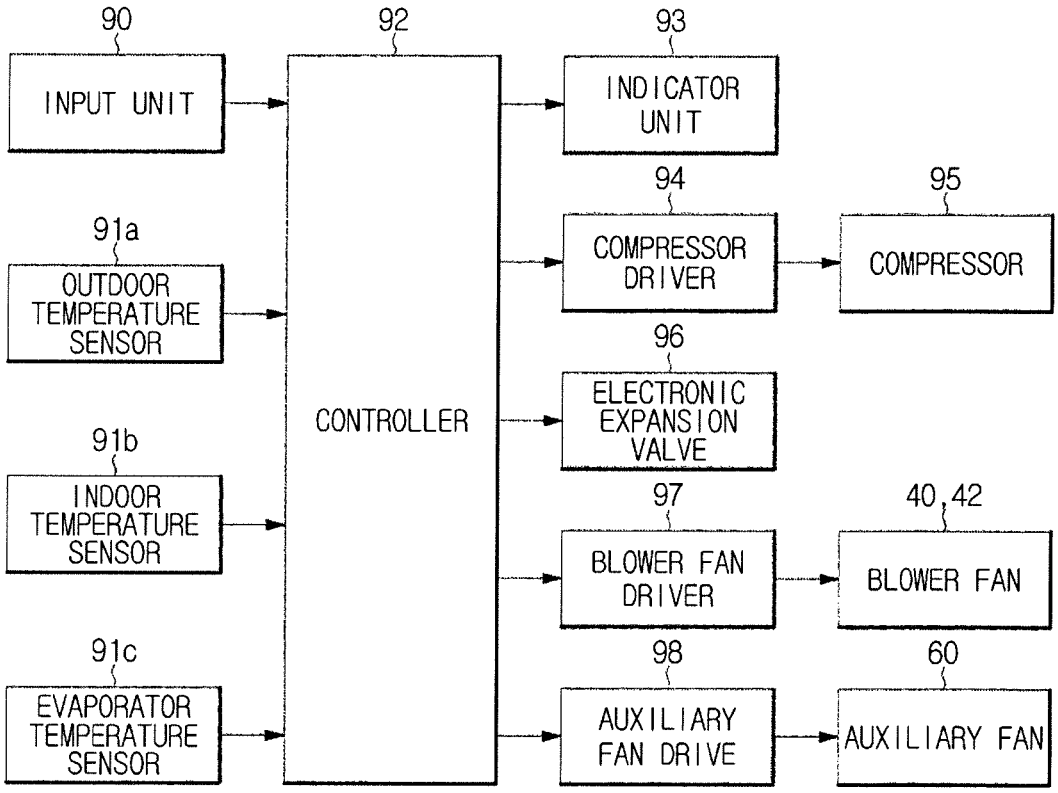

【Fig. 7】
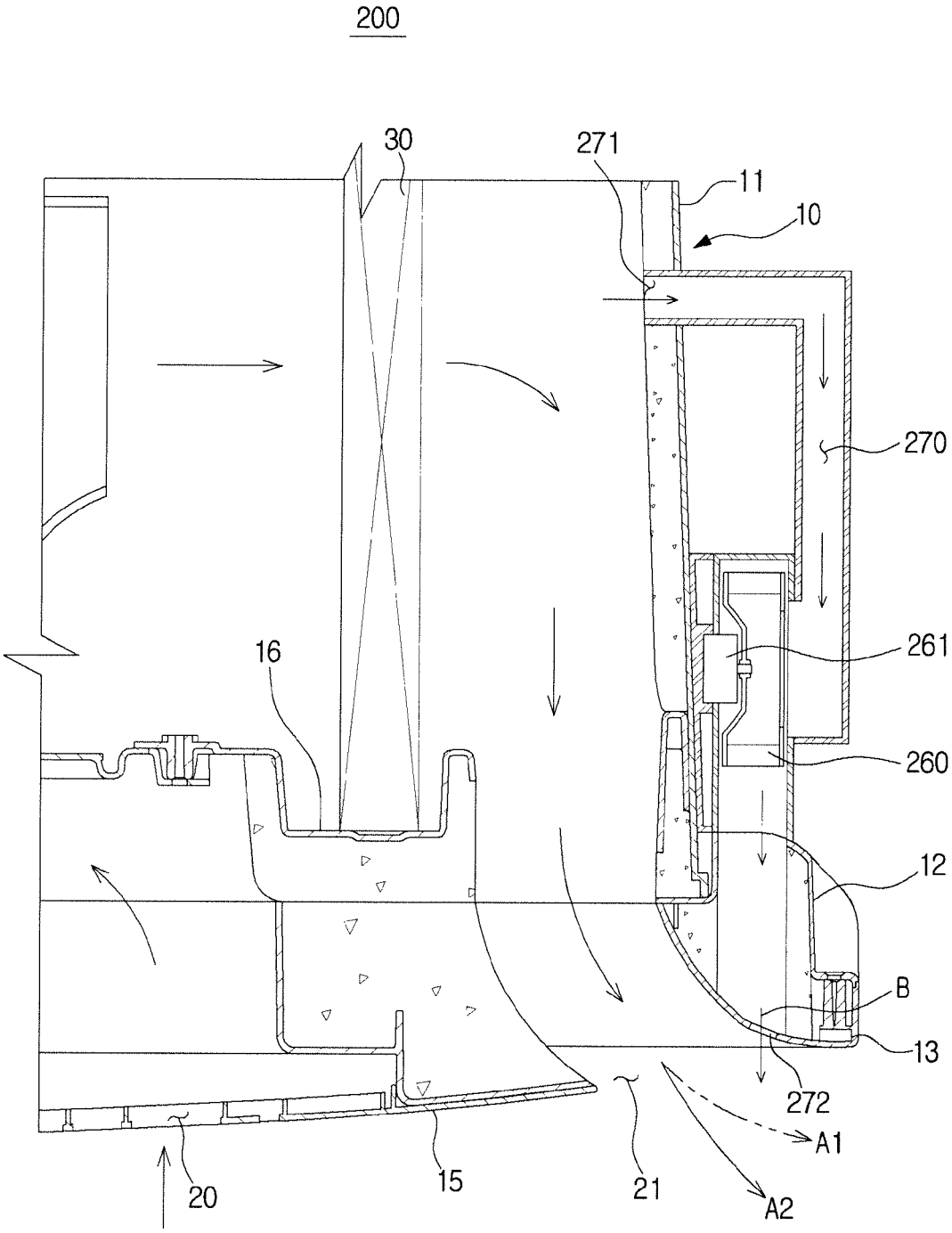

【Fig. 8】
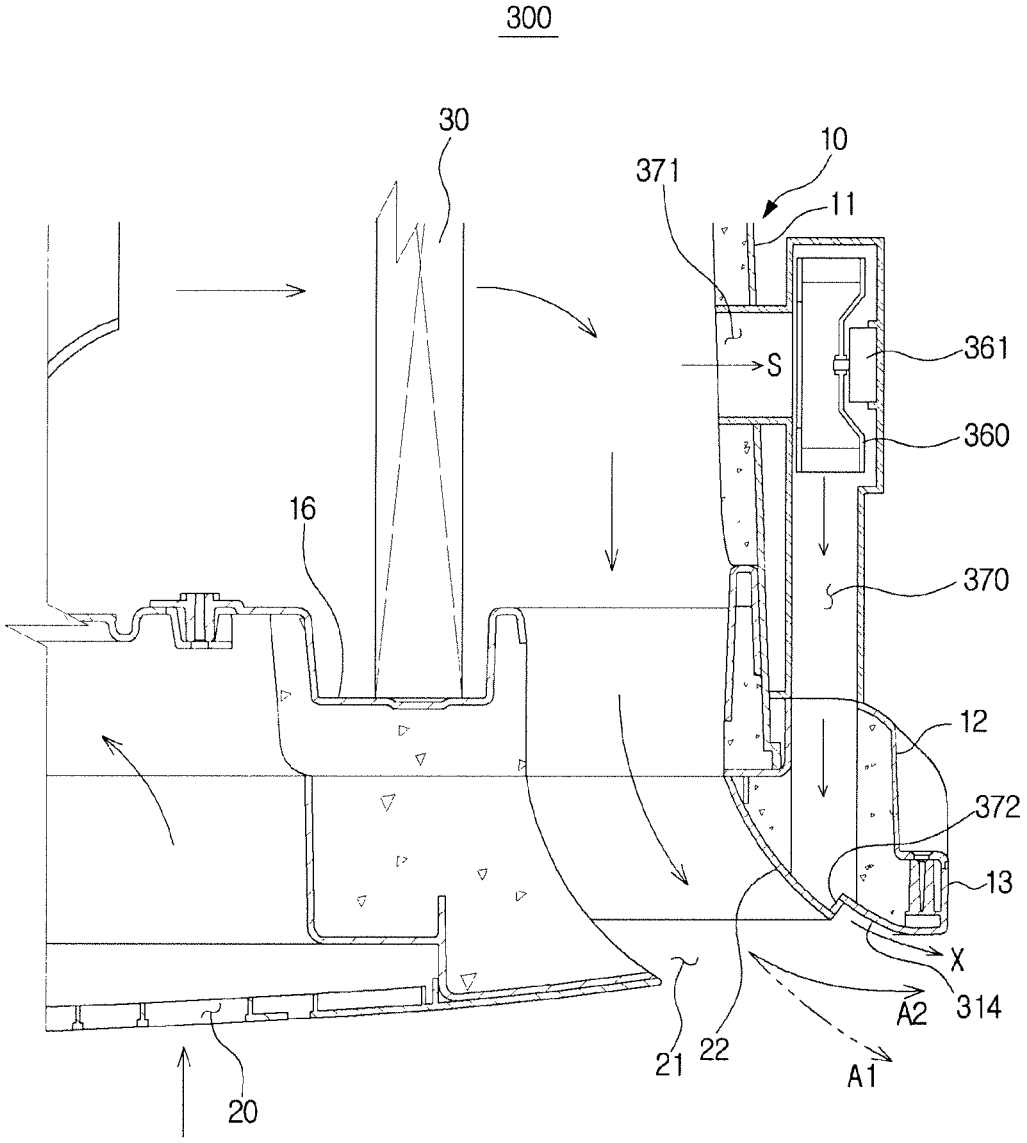

【Fig. 9】
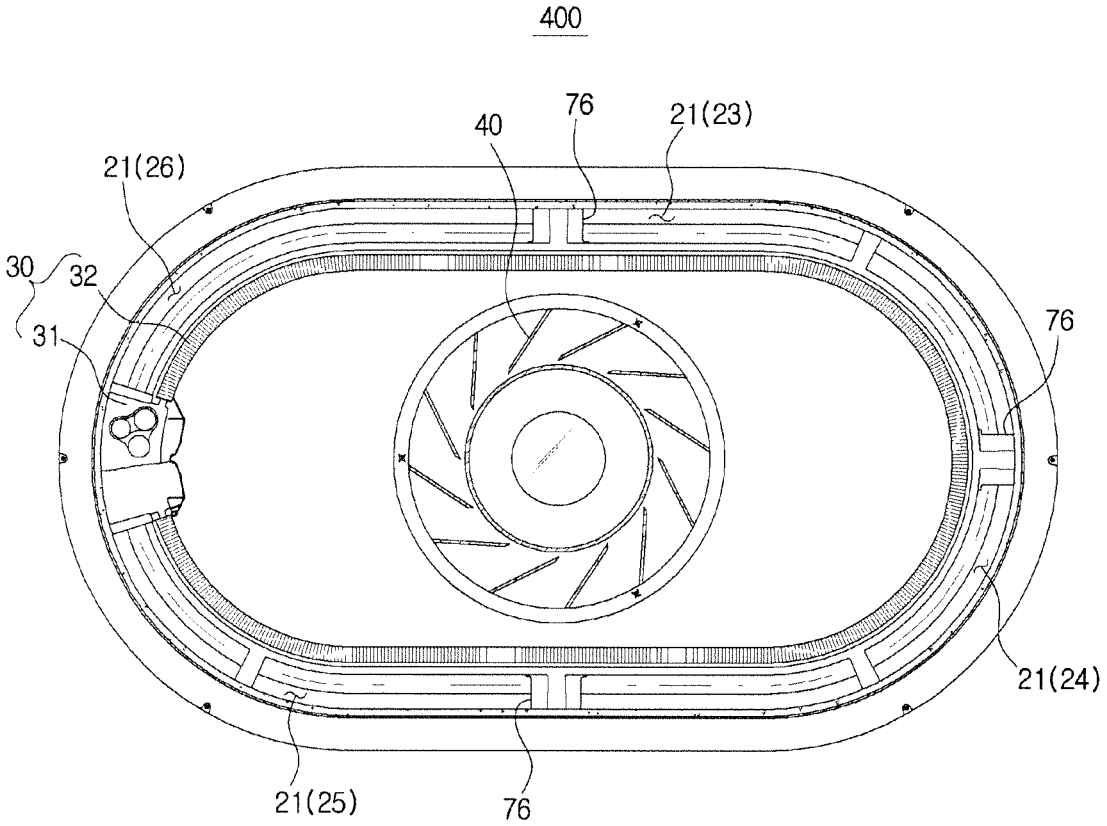

【Fig. 10】
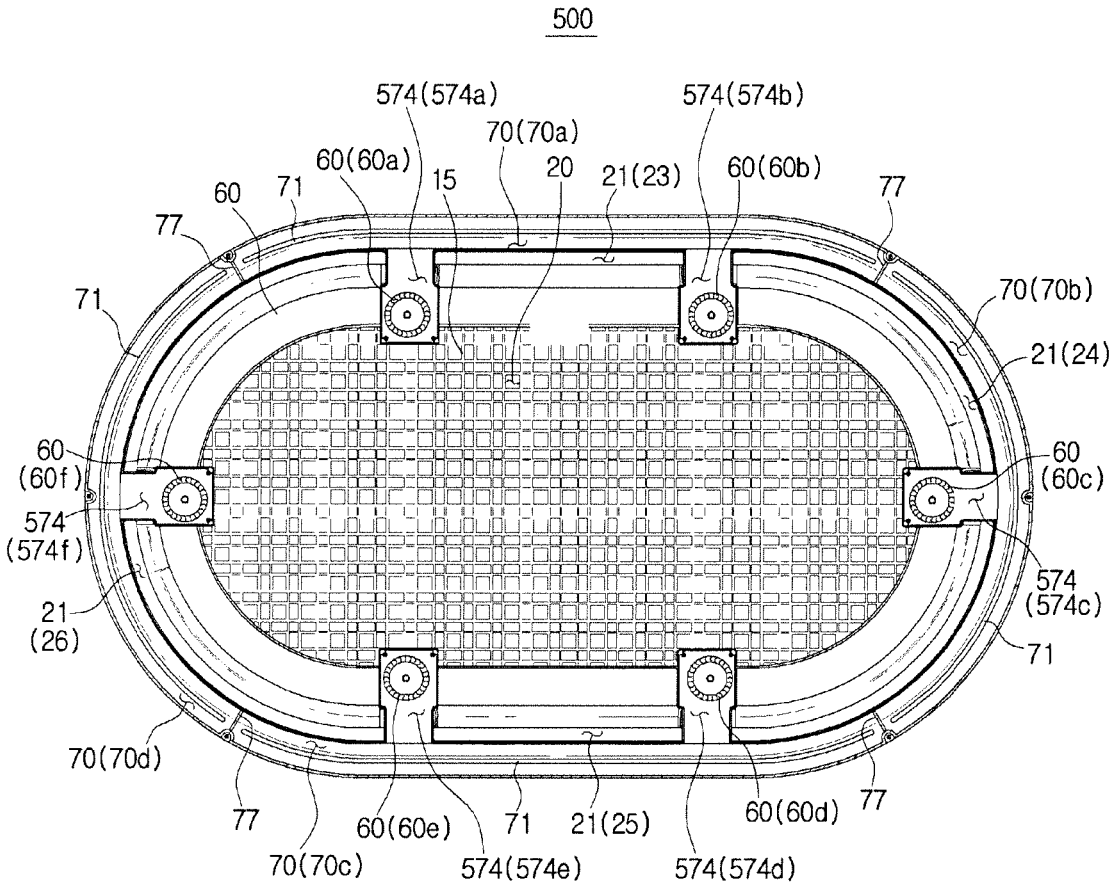

【Fig. 11】
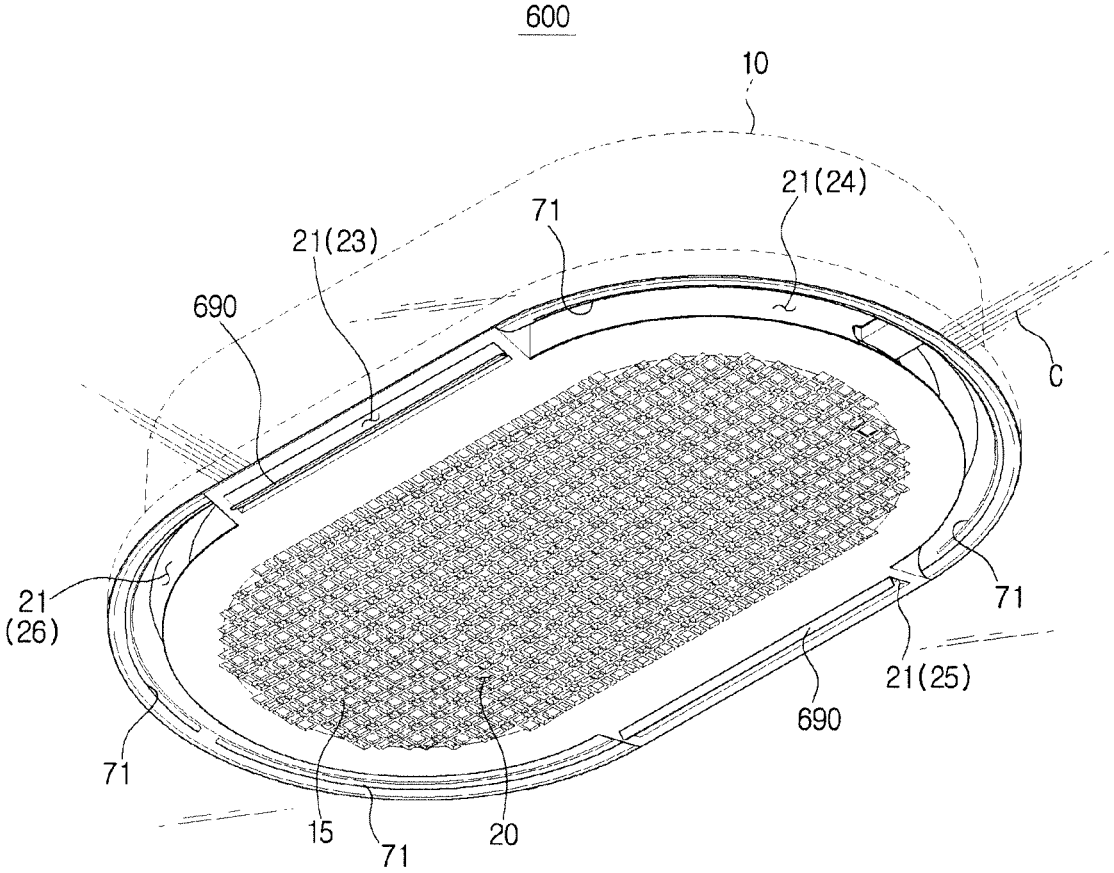

【Fig. 12】
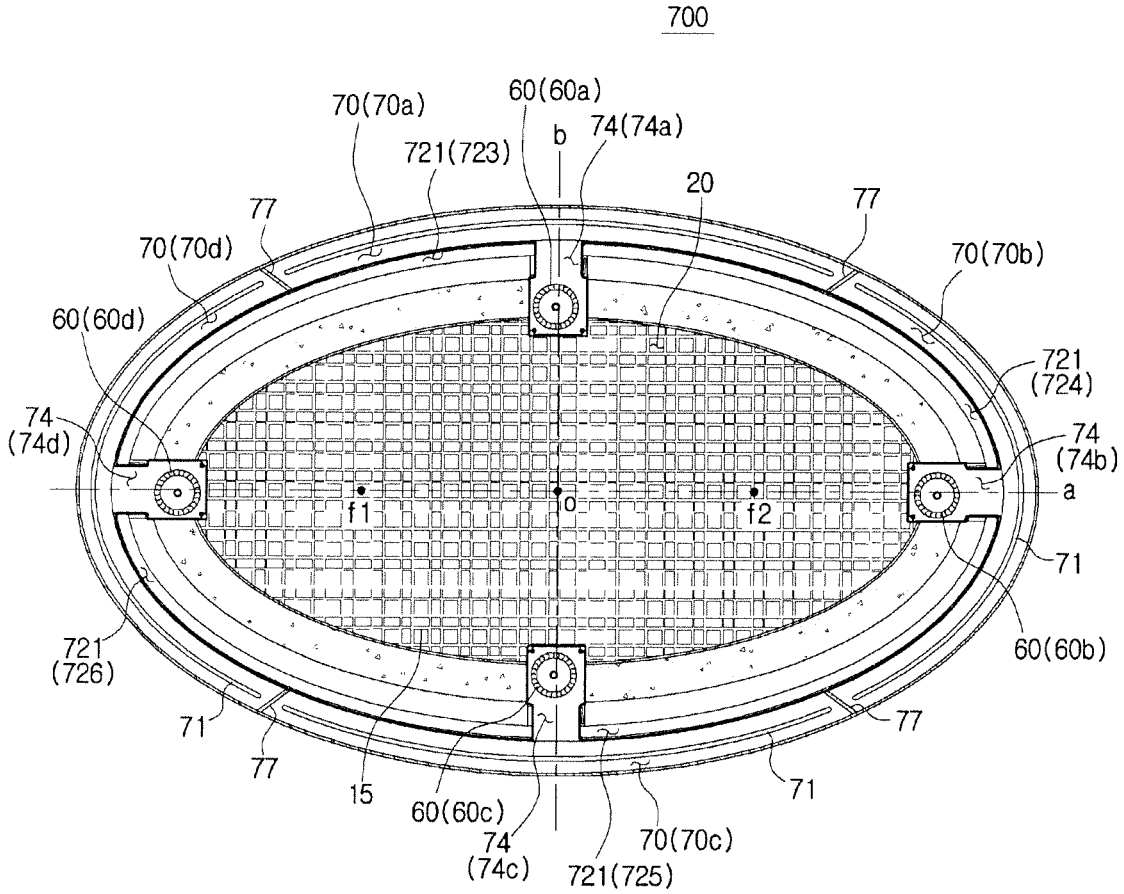

【Fig. 13】
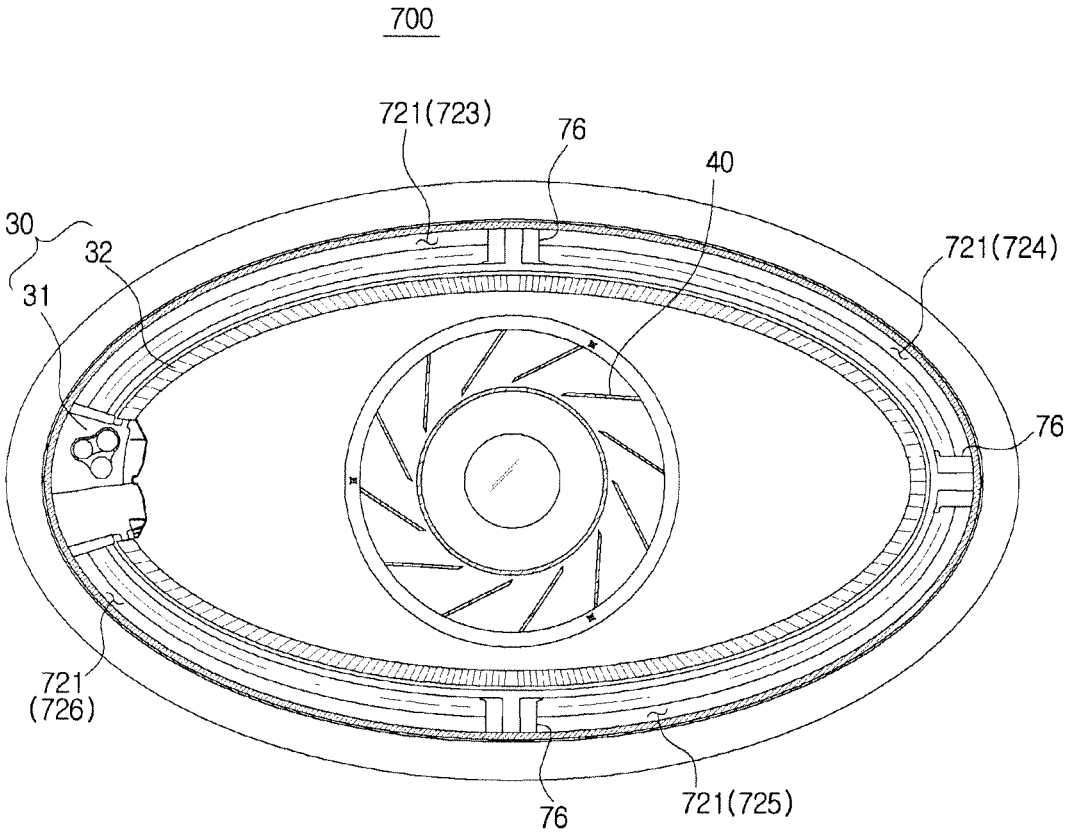

AIR CONDITIONER INDOOR UNIT

CROSS-REFERENCE TO RELATED APPLICATIONS

This application is a National Phase Application under 35 U.S.C. § 371 of PCT International Patent Application No. PCT/KR2016/013277, filed Nov. 17, 2016 which claims the foreign priority benefit under 35 U.S.C. § 119 to Korean Patent Application No. 10-2015-0163145 filed Nov. 20, 2015, the contents of which are incorporated herein by reference.

TECHNICAL FIELD

The present disclosure relates to an indoor unit of a ceiling-type air conditioner having a track-shaped or oval-shaped outlet.

BACKGROUND ART

An air conditioner (AC) is equipped with a compressor, a condenser, an expansion valve, an evaporator, a blower fan, and the like, for controlling indoor temperature, humidity, air currents, etc., using refrigeration cycles. The ACs may be classified into split air conditioners having two separate parts: the indoor unit to be installed indoors and the outdoor unit to be installed outdoors, and packaged ACs having the indoor unit and the outdoor unit located in a single housing.

The AC indoor unit includes a heat exchanger for exchanging heat between a refrigerant and air, a blower fan for circulating air, and a motor for driving the blower fan, to cool or heat the indoor space.

The AC indoor unit may also have a means for controlling a discharged air current, to discharge the air cooled or heated by the heat exchanger in various directions. The means for controlling a discharged air current may commonly include a vertical or horizontal blade equipped in an outlet, and a driving system for driving the blade to turn. The AC indoor unit controls the direction of an air current by controlling the turning angle of the blade.

With the structure to control a discharged air current using the blade, the amount of discharged air may be reduced because the blade interferes with the air flow, and circulating noise may increase due to the turbulence produced around the blade. Furthermore, since a pivot axis of the blade is formed to be straight, the shape of the outlet is restricted to the straight shape.

DISCLOSURE

Technical Problem

The present disclosure provides an indoor unit of a ceiling-type air conditioner having a track-shaped or oval-shaped outlet.

Technical Solution

In accordance with an aspect of the present disclosure, an air conditioner (AC) indoor unit is provided. The AC indoor unit includes a housing installed on the ceiling and having an inlet and an outlet provided around the inlet and having a pair of straight sections facing each other and a pair of curved sections facing each other; a heat exchanger provided inside the housing and arranged in a main flow path between the inlet and the outlet; a blower fan configured to suck in air through the inlet, allow the air to exchange heat with the heat exchanger, and discharge the air through the outlet; and an auxiliary flow path guiding an auxiliary air current to change a direction of an air current discharged from the outlet.

The auxiliary flow path may be formed by being branched from the main flow path.

The AC indoor unit may further include an auxiliary fan placed in the auxiliary flow path to produce the auxiliary air current.

The AC indoor unit may change the direction of the discharged air current by sucking in air around the outlet.

The auxiliary flow path may include an outer flow path formed on the outside of the outlet to suck in air; an inner flow path formed on the inside of the outlet to discharge air; and a bridge flow path crossing the outlet and connecting the outer flow path and the inner flow path.

The bridge flow path may be provided in each of the pair of straight sections and the pair of curved sections of the outlet.

The curved section of the outlet may have an arc form bulging outward.

The blower fan may be multiple in number, and the AC indoor unit may further include a guide wall between the multiple blower fans.

The AC indoor unit may change the direction of the discharged air current by blowing air around the outlet.

The AC indoor unit may push the direction of the discharged air current to an opposite side of the auxiliary air current by blowing air around the outlet.

The AC indoor unit may draw the direction of the discharged air current toward the auxiliary air current by blowing air around the outlet.

The auxiliary flow path may be provided to change a direction of an air current discharged from the curved section of the outlet, And the AC indoor unit may further include a blade provided to change a direction of an air current discharged from the straight section of the outlet.

In another aspect of the present disclosure, an air conditioner (AC) indoor unit is provided. The AC indoor unit includes a housing installed on the ceiling and having an inlet and an oval-shaped outlet provided around the inlet and having a major axis and a minor axis; a heat exchanger provided inside the housing and arranged in a main flow path between the inlet and the outlet; a blower fan configured to suck in air through the inlet, allow the air to exchange heat with the heat exchanger, and discharge the air through the outlet; and an auxiliary flow path guiding an auxiliary air current to change a direction of an air current discharged from the outlet.

Advantageous Effects

According to embodiments of the present disclosure, an indoor unit of a ceiling typed AC may have a track-shaped outlet having a straight section and a curved section.

According to embodiments of the present disclosure, an indoor unit of a ceiling typed AC may have an oval-shaped outlet.

According to embodiments of the present disclosure, as the AC indoor unit controls a discharged air current without a blade, a decrease in discharging amount due to the interference by the blade may be reduced.

According to embodiments of the present disclosure, as the AC indoor unit controls a discharged air current without a blade, circulation noise may be reduced.

DESCRIPTION OF DRAWINGS

FIG. 1 is a perspective view of an air conditioner (AC) indoor unit, according to a first embodiment of the present disclosure;

FIG. 2 is a side cross-sectional view of the AC indoor unit of FIG. 1;

FIG. 3 is an enlarged view of a dotted portion of FIG. 2;

FIG. 4 is a cross-sectional plan view cut along the line I-I of FIG. 2;

FIG. 5 is a cross-sectional view cut along the line II-II of FIG. 2;

FIG. 6 is a block diagram of a control system of the AC according to the first embodiment of the present disclosure;

FIG. 7 shows a key part of an AC indoor unit according to a second embodiment of the present disclosure, in comparison with that of FIG. 3;

FIG. 8 shows a key part of an AC indoor unit according to a third embodiment of the present disclosure, in comparison with that of FIG. 3;

FIG. 9 is a cross-sectional view of an AC indoor unit according to a fourth embodiment of the present disclosure, in comparison with that of FIG. 5;

FIG. 10 is a cross-sectional view of an AC indoor unit according to a fifth embodiment of the present disclosure, in comparison with that of FIG. 4;

FIG. 11 shows an AC indoor unit, according to a sixth embodiment of the present disclosure;

FIG. 12 shows an AC indoor unit according to a seventh embodiment of the present disclosure, in comparison with that of FIG. 4; and FIG. 13 shows the AC indoor unit according to the seventh embodiment of the present disclosure, in comparison with that of FIG. 5.

MODES OF THE INVENTION

Embodiments of the present disclosure are only the most preferred examples and provided to assist in a comprehensive understanding of the disclosure as defined by the claims and their equivalents. Accordingly, those of ordinary skilled in the art will recognize that various changes and modifications of the embodiments described herein can be made without departing from the scope and spirit of the disclosure.

In the drawings, well-known or unrelated components may be omitted for clarity and conciseness, and some components may be enlarged or exaggerated in terms of their dimensions or the like for better understanding.

Unless otherwise defined, all terms including technical and scientific terms used herein have the same meaning as commonly understood by one of ordinary skill in the art to which this invention belongs.

The terms and words used in the following description and claims are not limited to the bibliographical meanings, but, are merely used by the inventor to enable a clear and consistent understanding of the invention.

Terms like 'first', 'second', etc., may be used to indicate various components, but the components should not be restricted by the terms. These terms are only used to distinguish one element, component, region, layer or section from another region, layer or section.

As used herein, the singular forms "a", "an" and "the" are intended to include the plural forms as well, unless the context clearly indicates otherwise.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

If the term "in front of", "behind", "above", "below", "left" or "right" is used, it refers not only to an occasion when a component is located "in front of", "behind", "above", "below", "to the left of" or "to the right of" another component, but also to an occasion when a component is located "in front of", "behind", "above", "below", "to the left of" or "to the right of" another component with a third component lying between the components.

Reference will now be made in detail to embodiments, examples of which are illustrated in the accompanying drawings.

FIG. 1 is a perspective view of an air conditioner (AC) indoor unit, according to a first embodiment of the present disclosure. FIG. 2 shows a side cross-sectional view of the AC indoor unit of FIG. 1. FIG. 3 is an enlarged view of a dotted portion of FIG. 2. FIG. 4 is a cross-sectional view cut along the line I-I of FIG. 2. FIG. 5 is a cross-sectional view cut along the line II-II of FIG. 2. FIG. 9 is a cross-sectional view of an AC indoor unit according to a fourth embodiment of the present disclosure, in comparison with that of FIG. 5. FIG. 10 is a cross-sectional view of an AC indoor unit according to a fifth embodiment of the present disclosure, in comparison with that of FIG. 4.

Referring to FIGS. 1 to 5 and FIGS. 9 and 10, an AC indoor unit in accordance with embodiments of the present disclosure will be described.

An AC indoor unit 1 may be installed on the ceiling C. At least a part of the AC indoor unit 1 may be buried in the ceiling C.

The AC indoor unit 1 may include a housing 10 having an inlet 20 and an outlet 21, a heat exchanger 30 arranged inside the housing 10, and a blower fan 40, 42 for circulating air.

The housing 10 may be shaped like a rectangle or a track. The housing 10 may include a top housing 11, a middle housing 12 combined on the bottom of the top housing 11, and a bottom housing 13 combined on the bottom of the middle housing 12. At least parts of the top housing 11 and middle housing 12 may be buried in the ceiling C.

The inlet 20 for sucking in air may be formed in the center of the bottom housing 13, and the outlet 21 for discharging air may be formed around and outside the inlet 20.

The outlet 21 may be shaped like a track. Specifically, the outlet 21 may be formed around the inlet 20 to surround the inlet 20, and may have a pair of straight sections 23, 25 that face each other and a pair of curved sections 24, 26 that face each other.

The straight sections 23, 25 may have an elongated form along the long sides of the housing 10. The curved sections 24, 26 may have an arc form bulging outward and may be formed on the short sides of the housing 10.

With this structure, an AC indoor unit 1 may suck in air at the bottom, cool or heat the air, and discharge the cooled or heated air to the bottom. The AC indoor unit 1 may be placed in an almost rectangular room and may discharge air evenly to the room.

The bottom housing 13 may have a Coanda curved portion 14 to guide the air discharged through the outlet 21. The Coanda curved portion 14 may guide the air discharged though the outlet 21 to flow close to the Coanda curved portion 14, enabling the air to spread out more widely. The Coanda curved portion 14 may have the form that almost bulges to the outlet 21.

A grill 15 may be coupled to the bottom of the bottom housing 13 to filter out dust from the air sucked into the inlet 20.

A main flow path 35 may be formed between the inlet 20 and the outlet 21 to guide the main air current formed by the blower fan 40, 42, which will be described later.

The heat exchanger 30 may be located in the main flow path 35. The air moving in the main flow path 35 may exchange heat with the heat exchanger 30 while passing the heat exchanger 30. The heat exchanger 30 may include a tube 32 in which refrigerants circulate, and a header 31 connected to an external refrigerant tube to supply or collect refrigerants to or from the tube 32. The tube 32 may have heat exchange pins to expand a heat radiation area.

The heat exchanger 30 may be shaped like a track. Specifically, the tube 32 of the heat exchanger 30 may have the track shape. It is not, however, limited to this shape of the heat exchanger 30. The heat exchanger 30 may rest on a drain tray 16 for condensed water generated in the heat exchanger 30 to be collected in the drain tray 16.

The blower fan 40,42 may be located on an inner side of the heat exchanger 30 in the radial direction. The blower fan 40, 42 may be a centrifugal fan that sucks in air in the axial direction and releases the air in the radial direction. The blower fan 40,42 may be multiple in number. The multiple blower fans 40, 42 may be arranged side by side along the length direction of the housing 10.

Although there are two blower fans 40, 42 in this embodiment, there are no limitations on the number of the blower fans 40, 42 and there may be three or more blower fans unlike this embodiment. Alternatively, like an AC indoor unit 400 as shown in FIG. 9, there may be only one blower fan 40. The AC indoor unit 1 may include blower motors 41, 43 for respectively driving the blower fans 40, 42.

A guide wall 45 may be placed between the multiple blower fans 40, 42. The guide wall 45 may prevent the air currents produced by the multiple blower fans 40, 42 from interfering with each other. The guide wall 45 may divide the main flow path 35 connecting the inlet 20 and the outlet 21 into a first main flow path 36 and a second main flow path 37.

The AC indoor unit 1 may control the direction of the discharged air current by sucking in air around the outlet 21 to change the pressure. The AC indoor unit 1 may control the direction of the discharged air current by controlling the sucking amount of the air around the outlet 21. Controlling the direction of a discharged air current herein refers to controlling an angle of the discharged air current.

For this, the AC indoor unit 1 may include an auxiliary flow path 70 for guiding an auxiliary air current to change the direction of the discharged air current, an auxiliary fan 60 placed in the auxiliary flow path 70 for generating suction force, and an auxiliary fan motor 61 for providing driving force for the auxiliary fan 60. Once the suction force is generated by the auxiliary fan 60, the air around the outlet 21 may be sucked into the auxiliary flow path 70.

In sucking in air around the outlet 21, the AC indoor unit 1 may suck in air from one side of a direction in which the discharged air current flows. Specifically, as shown in FIG. 3, assuming that a direction in which the discharged air current flows is direction A1 when the AC indoor unit 1 is not sucking in air around the outlet 21, when the air around the outlet 21 is sucked in from one side of the direction A1, the direction in which the discharged air current flows may be changed to direction A2.

At this time, the angle of changing may be controlled based on the sucking amount of air. For example, the less the sucking amount of air, the smaller the angle of changing, and the more the sucking amount of air, the larger the angle of changing. The air sucked into the auxiliary flow path 70 may be discharged (D) to one side of the direction A1 in which the discharged air current flows.

The AC indoor unit 1 may suck in air from the outside of the outlet 21 in the radial direction (or from above the discharged air current). Like this, once the air is sucked in from the outside of the outlet 21 in the radial direction, the discharged air current may widely spread out from the center part of the outlet 21 in the radial direction to the outer side in the radial direction.

The auxiliary flow path 70 may be formed by being branched from the main flow path 35. Specifically, some of the air sucked in through the inlet 20 may be discharged to the outside through the main flow path 35 and the outlet 21, and some of the remaining air may be sucked back into the auxiliary flow path 70 from the outlet 21.

The auxiliary flow path 70 includes an inflow hole 71 for sucking in air around the outlet 21 and an outflow hole 72 for discharging the air sucked in.

The inflow hole 71 may be formed in the Coanda curved portion 14 of the bottom housing 13. Accordingly, the discharged air current bent toward the inflow hole 71 of the bottom housing 13 according to suction force of the auxiliary fan 60 may flow across the surface of the Coanda curved portion 14.

The inflow hole 71 may have a plurality of slits or continuous slits arranged along the outlet 21 at predetermined intervals. The outflow hole 72 may be located around the outlet 21 on the opposite side to the inflow hole 71.

The auxiliary flow path 70 may include an outer flow path 73 formed on the outside of the outlet 21, an inner flow path 75 formed on the inside of the outlet 21, and a bridge flow path 74 crossing the outlet 21 and connecting the outer flow path 73 and the inner flow path 75.

The outer flow path 73 may be connected to the inflow hole 71, and the inner flow path 75 may be connected to the outflow hole 72.

Accordingly, the air sucked in through the inflow hole 71 may be discharged out of the outflow hole 72 through the outer flow path 73, the bridge flow path 74, and the inner flow path 75.

The bridge flow path 74 may be formed in the pair of straight sections 23, 25 and the pair of curved sections 24, 26 of the outlet 21. Accordingly, there may be a total of four bridge flow paths 74: 74*a*, 74*b*, 74*c*, and 74*d*.

The bridge flow path 74*a* is formed in the middle of the straight section 23; the bridge flow path 74*b* in the middle of the curved section 24; the bridge flow path 74*c* in the middle of the straight section 25; the bridge flow path 74*d* in the middle of the curved section 26.

The bridge flow path 74 may be formed inside the bridge 76 of the housing 10.

From another perspective, the AC indoor unit 1 may have separate four auxiliary flow paths 70*a*, 70*b*, 70*c*, and 70*d*. The auxiliary flow paths 70*a*, 70*b*, 70*c*, and 70*d* may be partitioned by partition walls 77. The auxiliary flow paths 70*a*, 70*b*, 70*c*, and 70*d* may divide the outlet 21 into four to control the discharged air current.

The first auxiliary flow path 70*a*, the second auxiliary flow path 70*b*, the third auxiliary flow path 70*c*, and the fourth auxiliary flow path 70*d* may control discharged air currents of an outlet 24, an outlet 25, an outlet 26, and an outlet 27, respectively.

With this configuration and arrangement, control efficiency of discharged air currents may be maximized with minimum configurations. This is because there is a difference in discharging amount as the distance between the blower fans 40 and 42 and the straight sections 23 and 25 of the outlet 21 and the distance between the blower fans 40 and 42 and the curved sections 24 and 26 of the outlet 21 are different. In other words, the straight sections 23 and 25 may have a relatively larger discharging amount because they are closer to the blower fans 40 and 42 than the curved sections 24 and 26 are.

Controlling outputs of the auxiliary fans 60*a*, 60*b*, 60*c*, and 60*d* placed in the auxiliary flow paths 70*a*, 70*b*, 70*c*, and 70*d* differently may make angles of discharged air currents in the respective sections uniform. In other words, the outputs of the auxiliary fans 60*a* and 60*c* that control discharged air currents in the straight sections 23 and 25 may be controlled to be relatively greater than the outputs of the auxiliary fans 60*b* and 60*d* that control discharged air currents in the curved sections 24 and 26.

The auxiliary fans 60*a* and 60*c* for controlling discharged air currents in the straight sections 23 and 25 may have the higher rpm than the rpm of the auxiliary fans 60*b* and 60*d* for controlling discharged air currents in the curved sections 24 and 26, or the auxiliary fans 60*a* and 60*c* for controlling discharged air currents in the straight sections 23 and 25 may have a larger size than the size of the auxiliary fans 60*b* and 60*d* for controlling discharged air currents in the curved sections 24 and 26.

From another perspective, the distance from the blower fans 40 and 42 to the auxiliary fans 60*a* and 60*c* that control discharged air currents in the straight sections 23 and 25 may be relatively shorter than the distance to the auxiliary fans 60*b* and 60*d* that control discharged air currents in the curved sections 24 and 26.

The auxiliary fans 60*a*, 60*b*, 60*c*, and 60*d* may be separately controlled according to the distance to the blower fans 40 and 42.

However, this embodiment is only by way of example, and there are no limitations on the number and positions of the bridge flow paths 74 and the number and positions of the auxiliary flow paths 70*a*, 70*b*, 70*c*, and 70*d*.

For example, like an AC indoor unit 500 of the fifth embodiment of the present disclosure shown in FIG. 10, there may be six bridge flow paths 574: 574*a*, 574*b*, 574*c*, 574*d*, 574*e*, and 574*f*.

The bridge flow paths 574*a* and 574*b* are formed in the straight section 23; the bridge flow path 574*c* is formed in the curved section 24; the bridge flow paths 574*d* and 574*e* are formed in the straight section 25; the bridge flow path 574*f* is formed in the curved section 26.

There may be a total of six auxiliary fans 60: 60*a*, 60*b*, 60*c*, 60*d*, 60*e*, and 60*f* as well.

Although the auxiliary fan 60 corresponds to a centrifugal fan in this embodiment, it is not limited thereto, and various fans, such as axial-flow fans, cross-flow fans, mixed flow fans, etc., may also be used for the air current control fan 60 depending on the design specification. The auxiliary fan 60 may be mounted inside a fan case 62.

With the structure, the AC indoor unit in accordance with embodiments of the present disclosure may control a discharged air current without a blade structure, as compared to a conventional AC indoor unit in which a blade is arranged in the outlet and an air current is controlled by turning the blade. Accordingly, since there is no interference by a blade, an amount of discharging may increase and circulation noise may be lessened.

Unlike the conventional AC indoor unit having an outlet that has to be in a straight shape to turn a blade, the AC indoor unit in accordance with the embodiment of the present disclosure may be allowed to have a track-shaped outlet because the discharged air current is controlled through an auxiliary air current. Furthermore, given that the shape of the blower fan is circular, the air current flows smoothly, the pressure loss is reduced, and consequently, AC cooling or heating performance may be improved.

FIG. 6 is a block diagram of an AC control system, according to the first embodiment of the present disclosure.

An AC may include a controller 92 for controlling general operation, an input unit 90 for receiving operation instructions, an outdoor temperature sensor 91*a* for detecting an outdoor temperature, an indoor temperature sensor 91*b* for detecting an indoor temperature, an evaporator temperature sensor 91*c* for detecting temperature of an evaporator, an indicator 93 for indicating various information to the outside, a compressor driver 94 for driving a compressor 95, an electronic expansion valve 96, a blower fan driver 97 for driving the blower fan 40,42, and an auxiliary fan driver 98 for driving the auxiliary fan 60.

The controller 92 may receive various operation instructions and/or temperature information from the input unit 90, outdoor temperature sensor 91*a*, indoor temperature sensor 91*b*, and evaporator temperature sensor 91*c*, and send control instructions to the indicator 93, compressor driver 94, electronic expansion valve 96, blower fan driver 97, and auxiliary fan driver 98 based on the received instruction and/or information.

The auxiliary fan driver 98 may control whether to drive the auxiliary fan motor 61 and the driving speed according to the control instruction from the controller 92. By doing this, it may control an amount of air to be sucked in around the outlet 21 and the direction of a discharged air current.

FIG. 7 shows a key part of an AC indoor unit according to a second embodiment of the present disclosure, in comparison with that of FIG. 3.

Referring to FIG. 7, an AC indoor unit in accordance with the second embodiment of the present disclosure will be described. The same features as in the aforementioned embodiment are denoted by the same reference numerals, and the overlapping description will not be repeated.

The AC indoor unit 200 may control the direction of the discharged air current by not sucking in the air around the outlet 21 but blowing air to the periphery of the outlet 21. The AC indoor unit 200 may control the direction of the discharged air current by controlling the blowing amount of the air being blown to the periphery of the outlet 21.

For this, the AC indoor unit 200 may include an auxiliary flow path 270 for guiding an auxiliary air current to change the direction of the discharged air current, an auxiliary fan 260 placed in the auxiliary flow path 270 for generating blowing force, and an auxiliary fan motor 261 for providing driving force for the auxiliary fan 260. Once the blowing force is generated by the auxiliary fan 260, air may be blown to the periphery of the outlet 21 through the auxiliary flow path 270.

In blowing air to the periphery of the outlet 21, the AC indoor unit 200 may blow the air to one side of a direction in which the discharged air current flows. Specifically, as shown in FIG. 7, assuming that a direction in which the discharged air current flows is direction A1 when the AC indoor unit 200 is not blowing air to the periphery of the outlet 21, when the air is blown to one side of the direction A1, the direction in which the discharged air current flows may be changed to direction A2.

The auxiliary flow path 270 may suck in air from inside of the housing 10. The auxiliary flow path 270 may be formed by being branched from the main flow path 35. Specifically, some of the air sucked in through the inlet 20 may be discharged to the outside through the main flow path 35 and the outlet 21, and some of the remaining air may be discharged through the auxiliary flow path 270. The auxiliary flow path 270 includes an inflow hole 271 for sucking in air and an outflow hole 272 for discharging the air sucked in.

FIG. 8 shows a key part of an AC indoor unit according to a third embodiment of the present disclosure, in comparison with that of FIG. 3.

Referring to FIG. 8, an AC indoor unit in accordance with the third embodiment of the present disclosure will be described. The same features as in the aforementioned embodiment are denoted by the same reference numerals, and the overlapping description will not be repeated.

An AC indoor unit 300 may control the direction of the discharged air current by blowing air to the periphery of the outlet 21 to change the pressure, as shown in FIG. 7. However, unlike FIG. 7 in which the AC indoor unit controls the discharged air current by pushing the discharged air current, the AC indoor unit in accordance with this embodiment may control the discharged air current by pulling in the discharged air current.

For this, a Coanda curved portion 314 is formed around the outlet 21, and an AC indoor unit 300 may discharge an auxiliary air current X in the direction tangential to the Coanda curved portion 314.

The Coanda curved portion 314 may guide the auxiliary air current X discharged through an outflow hole 372 to flow close to the surface of the Coanda curved portion 314 according to the Coanda effect. The Coanda curved portion 314 may be formed integrally with the housing 10, e.g., the bottom housing 13.

The Coanda curved portion 314 may have an almost bulging form toward the outlet 21. Accordingly, the velocity of the auxiliary air current X flowing across the Coanda curved portion 314 may increase, and the pressure may decrease. Thus, the air current discharged through the outlet 21 may be pulled in toward the auxiliary air current X to change its direction from A1 to A2.

The direction of the auxiliary air current X discharged through the outflow hole 372 may be tangential to the Coanda curved portion 314 while approximately corresponding to the direction of the discharged air current.

An auxiliary flow path 370 for guiding the auxiliary air current X includes an inflow hole 371 for sucking in air and the outflow hole 372 for discharging the air sucked in. The outflow hole 372 is formed near the Coanda curved portion 314 such that the auxiliary air current X is discharged in the direction tangential to the Coanda curved portion 314. Specifically, the outflow hole 372 may be formed between the inner circumferential face 22 of the outlet 21 and the Coanda curved portion 314.

The AC indoor unit 300 may blow the auxiliary air from the outside of the outlet 21 in the radial direction (or from above the discharged air current). Specifically, the discharged air current may be relatively concentrated when the auxiliary air current X is not blown, and may relatively widely spread out when the auxiliary air current X is blown.

The AC indoor unit 300 may include an auxiliary fan 360 for blowing air to generate the auxiliary air current X, and an auxiliary fan motor 361 for driving the auxiliary fan 360.

To increase the force of the auxiliary air current X drawing in the discharged air current, the velocity of the auxiliary air current X may be increased. In other words, the faster the velocity of the auxiliary air current X, the greater the reduction of pressure, which may increase the force of drawing in the discharged air current. The velocity of the auxiliary air current X may be higher than at least that of the discharged air current.

FIG. 11 shows an AC indoor unit, according to a sixth embodiment of the present disclosure. Referring to FIG. 11, the AC indoor unit in accordance with the sixth embodiment of the present disclosure will be described. The same features as in the aforementioned embodiment are denoted by the same reference numerals, and the overlapping description will not be repeated.

Although in the previous embodiments all the directions of the air currents discharged from the straight sections 23 and 25 and the curved sections 24 and 26 of the track-shaped outlet 21 are controlled through the auxiliary air current, the air current discharged from the curved sections 24 and 26 of the track-shaped outlet 21 may be controlled through the auxiliary air current while the air current discharged from the straight sections 23 and 25 may be controlled by a blade 690. The blade 690 may be provided in the straight section 23, 25 to pivot around the pivot axis, thereby opening or closing the straight section 23, 25 of the outlet 21 or changing the direction of the discharged air current.

FIG. 12 shows an AC indoor unit according to a seventh embodiment of the present disclosure in comparison with that of FIG. 4. FIG. 13 shows the AC indoor unit according to the seventh embodiment of the present disclosure in comparison with that of FIG. 5.

An outlet 721 of an AC indoor unit 700 may have an oval shape. The term 'oval' as herein used refers to a trajectory of dots, each dot having a constant sum of distances to two focal points f1, f2. An oval has a major axis a, a longest straight line connecting two arbitrary points and passing a center point O and a minor axis b, a shortest straight line.

The AC indoor unit 700 may control the direction of the discharged air current by sucking in air around the outlet 721 to change the pressure.

For this, the AC indoor unit 700 may include the auxiliary flow path 70 for guiding an auxiliary air current to change the direction of the discharged air current, and the auxiliary fan 60 placed in the auxiliary flow path 70 for generating suction force.

The auxiliary flow path 70 may include the outer flow path 73 formed on the outside of the outlet 721 to suck in air, the inner flow path 75 formed on the inside of the outlet 721 to discharge air, and the bridge flow path 74 crossing the outlet 721 and connecting the outer flow path 73 and the inner flow path 75.

There may be a plurality of bridge flow paths 74 located at symmetrical positions in the major axis a of the outlet 721 and at symmetrical positions in the minor axis b of the outlet 721. Accordingly, there may be a total of four bridge flow paths 74: 74*a*, 74*b*, 74*c*, and 74*d*.

From another perspective, the AC indoor unit 700 may have separate four auxiliary flow paths 70*a*, 70*b*, 70*c*, and 70*d*. The auxiliary flow paths 70*a*, 70*b*, 70*c*, and 70*d* may be partitioned by partition walls 77. The auxiliary flow paths 70*a*, 70*b*, 70*c*, and 70*d* may divide the outlet 721 into four to control the discharged air current.

Based on what is shown in FIG. 12, the first auxiliary flow path 70*a*, the second auxiliary flow path 70*b*, the third auxiliary flow path 70*c*, and the fourth auxiliary flow path 70*d* may control discharged air currents of an upper outlet 723, a right outlet 724, a lower outlet 725, and a left outlet 726, respectively.

With this configuration and arrangement, control efficiency of discharged air currents may be maximized with minimum configurations. This is because there is a difference in discharging amount as the distance between the blower fan 40 and the outlets 723, 725 on the minor axis and the distance between the blower fan 40 and the outlets 724, 726 on the major axis are different.

In other words, as the outlets 723, 725 on the minor axis are closer to the blower fan 40 than the outlets 724, 726 on the major axis are, they may have relatively larger discharging amounts.

Controlling outputs of the auxiliary fans 60*a*, 60*b*, 60*c*, and 60*d* placed in the auxiliary flow paths 70*a*, 70*b*, 70*c*, and 70*d* differently may make angles of air currents discharged from the respective outlets uniform. In other words, the outputs of the auxiliary fans 60*a* and 60*c* that control discharged air currents of the outlets 723, 725 on the minor axis may be controlled to be relatively greater than the outputs of the auxiliary fans 60*b* and 60*d* that control discharged air currents of the outlets 724, 726 on the major axis.

The auxiliary fans 60*a* and 60*c* for controlling discharged air currents of the outlets 723, 725 on the minor axis may have the higher rpm than the rpm of the auxiliary fans 60*b* and 60*d* for controlling discharged air currents of the outlets 724, 726 on the major axis, or the auxiliary fans 60*a* and 60*c* for controlling discharged air currents of the outlets 723, 725 on the minor axis may have a larger size than the size of the auxiliary fans 60*b* and 60*d* for controlling discharged air currents of the outlets 724, 726.

From another perspective, the distance from the blower fan 40 to the auxiliary fans 60*a* and 60*c* that control discharged air currents of the outlets 723, 725 on the minor axis may be relatively shorter than the distance to the auxiliary fans 60*b* and 60*d* that control discharged air currents of the outlets 724, 726 on the major axis.

The auxiliary fans 60*a*, 60*b*, 60*c*, and 60*d* may be separately controlled according to the distance to the blower fan 40.

However, this embodiment is only by way of example, and there are no limitations on the number and positions of the bridge flow paths 74 and the number and positions of the auxiliary flow paths 70*a*, 70*b*, 70*c*, and 70*d*.

The invention claimed is:

1. An air conditioner (AC) indoor unit comprising:

a housing installed on the ceiling and having an inlet and an outlet provided around the inlet;

a heat exchanger provided inside the housing and arranged in a main flow path between the inlet and the outlet;

a blower fan configured to suck in air through the inlet, allow the air to exchange heat with the heat exchanger, and discharge the air through the outlet;

an auxiliary flow path guiding an auxiliary air current to change a direction of an air current discharged from the outlet; and a plurality of auxiliary fans located in the auxiliary flow path to form the auxiliary air current and independently controlled based on the distance to the blower fan, wherein the housing is formed to have a long side and a short side and the outlet is provided to have a curved section along the circumference of the housing.

2. The AC indoor unit of claim 1, wherein the auxiliary flow path is formed by being branched from the main flow path.

3. The AC indoor unit of claim 1, wherein the auxiliary fans are independently controlled such that the flow of air current generated by the auxiliary fans increases as the distance to the blower fan decreases.

4. The AC indoor unit of claim 1, wherein the direction of the discharged air current is changed by sucking in air around the outlet.

5. The AC indoor unit of claim 1, wherein the auxiliary flow path comprises an outer flow path formed on the outside of the outlet to suck in air;

an inner flow path formed on the inside of the outlet to discharge air; and a bridge flow path crossing the outlet and connecting the outer flow path and the inner flow path.

6. The AC indoor unit of claim 5, wherein the bridge flow path is provided in the outlet.

7. The AC indoor unit of claim 1, wherein the curved section of the outlet has an arc form bulging outward.

8. The AC indoor unit of claim 1, wherein the blower fan comprises multiple blower fans, and the AC indoor unit further comprises a guide wall provided between the multiple blower fans.

9. The AC indoor unit of claim 1, wherein the direction of the discharged air current is changed by blowing air around the outlet.

10. The AC indoor unit of claim 9, wherein the discharged air current is pushed in a direction opposite to a direction of the auxiliary air current by blowing air around the outlet.

11. The AC indoor unit of claim 9, wherein the discharged air current is drawn in a direction toward the auxiliary air current by blowing air around the outlet.

12. An air conditioner (AC) indoor unit comprising:

a housing installed on the ceiling and having an inlet and an oval-shaped outlet provided around the inlet and having a major axis and a minor axis;

a heat exchanger provided inside the housing and arranged in a main flow path between the inlet and the outlet;

a blower fan configured to suck in air through the inlet, allow the air to exchange heat with the heat exchanger, and discharge the air through the outlet;

an auxiliary flow path guiding an auxiliary air current to change a direction of an air current discharged from the outlet; and a plurality of auxiliary fans located in the auxiliary flow path to form the auxiliary air current and independently controlled based on the distance to the blower fan.

13. The AC indoor unit of claim 12, wherein the auxiliary flow path comprises an outer flow path formed on the outside of the outlet to suck in air;

an inner flow path formed on the inside of the outlet to discharge air; and a bridge flow path crossing the outlet and connecting the outer flow path and the inner flow path.

14. The AC indoor unit of claim 13 wherein the bridge flow path comprises plural bridge flow paths, and wherein the plurality of the bridge flow paths are provided to be symmetrical on the long side and the short side, respectively.

* * * * *